United States Patent [19]

Knecht

[11] Patent Number: 4,503,293

[45] Date of Patent: Mar. 5, 1985

[54] INTERLOCKING PLUG AND RECEPTACLE MECHANISM WITH ACTUATING MEANS

[75] Inventor: George W. Knecht, Brooklyn, N.Y.

[73] Assignee: Midland-Ross Corporation, Cleveland, Ohio

[21] Appl. No.: 450,808

[22] Filed: Dec. 17, 1982

[51] Int. Cl.[3] ..... H01H 9/20

[52] U.S. Cl. ..... 200/50 B; 200/50 A

[58] Field of Search ..... 200/50 A, 50 B, 153 G, 200/153 H

[56] References Cited

U.S. PATENT DOCUMENTS

| | | | |
|---|---|---|---|
| 1,818,290 | 8/1931 | Wulle | 200/50 B |
| 1,924,691 | 8/1933 | Lofgren | 200/50 B |
| 2,015,543 | 9/1935 | Bissell | 200/50 B |
| 2,441,465 | 5/1948 | Bauroth | 200/50 B |
| 2,470,944 | 5/1949 | Parish | 200/50 B |
| 3,284,591 | 11/1966 | Daly | 200/50 A |
| 3,980,845 | 9/1976 | Gryctko et al. | 200/50 A |

*Primary Examiner*—J. R. Scott

*Attorney, Agent, or Firm*—H. Duane Switzer

[57] ABSTRACT

An interlocking plug and receptacle mechanism which involves actuating means for operating an electrical device which is environmentally isolated from the atmosphere in an enclosure. The electrical device, specifically a circuit breaker, includes a toggle switch lever which is positionable in at least first and second positions. The enclosure includes a receptacle for receiving an electrical plug. An actuating linkage enables the electrical device to be operated from the exterior of the enclosure. An operating handle is connected with a first lever arm and a pin. A pivotally mounted slide plate has an aperture which receives the toggle switch lever and defines an elongated slot which receives the pin. A locking mechanism is connected with the actuating linkage and receptacle for locking the toggle switch lever in the second position in the absence of a plug fully received in the receptacle. The locking mechanism also locks a fully received plug in the receptacle when the toggle switch lever is disposed in the first position.

21 Claims, 8 Drawing Figures

FIG. 5
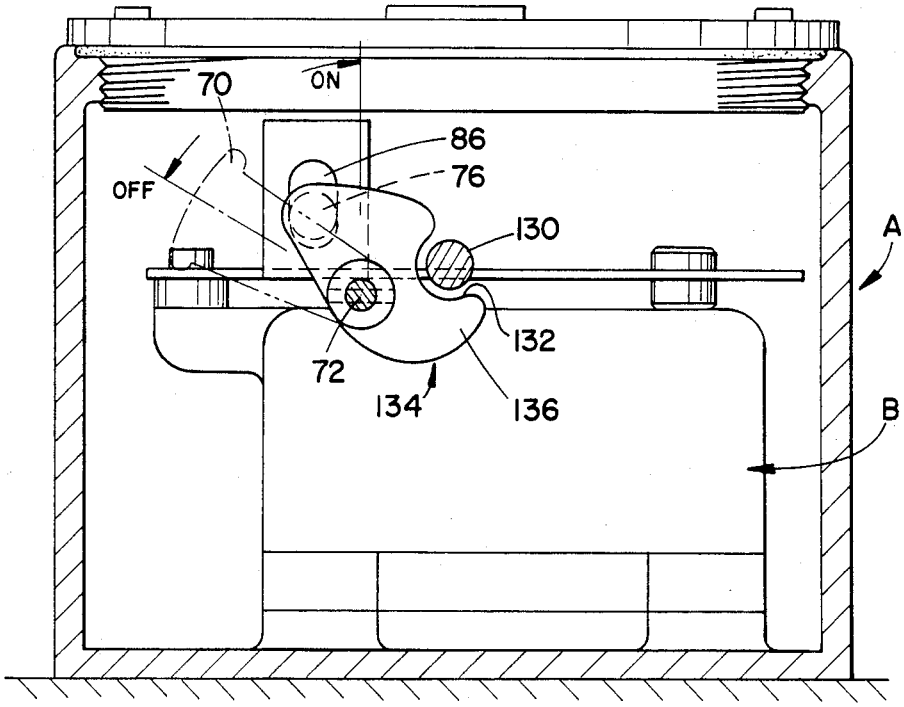
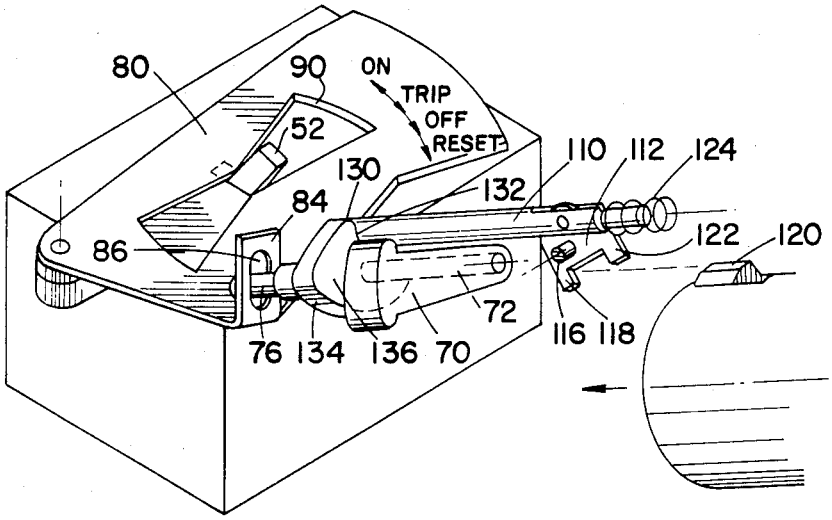
FIG. 6

INTERLOCKING PLUG AND RECEPTACLE MECHANISM WITH ACTUATING MEANS

BACKGROUND OF THE INVENTION

This application pertains to the art of electrical equipment and, more particularly, to potential spark generating electrical equipment such as circuit breakers, switches, motor starters, and the like for use in hazardous environments.

The invention finds specific application in housing and actuating electrical equipment in explosive or potentially explosive environments, that is, in environments where the air may contain fumes or dust which could be ignited by a spark. The present invention is also advantageous in other hazardous environments, e.g., environments in which the air has a high moisture content, underwater applications, and the like.

Heretofore, various mechanisms have been proposed for actuating switches, circuit breakers, and the like in hazardous environments. These prior art devices commonly comport with the requirements of various international and national safety codes. Most commonly, potentially sparking or arcing electrical equipment is placed in a housing or enclosure through which mechanical mechanisms extend for actuating the equipment from the exterior of the housing. An electrical receptacle is commonly connected with the housing for selectively receiving an electrical plug from controlled electrical machinery. Although sealed to a large extent, the housing is rarely completely sealed to the highly pervasive ignitable gases and dusts. Rather, the housing is designed to prevent an internal ignition from passing to the atmosphere. This is commonly accomplished by designing the housing as a pressure vessel capable of withstanding pressures up to 1,000 psi and otherwise preventing the housing from rupturing if an internal ignition should occur. Further, the various ports and apertures through the housing for accommodating mechanical actuating mechanisms, electrical conductors, and the like are designed to form thin flame paths which are elongated sufficiently to cool any flame or hot particles before exiting at the atmospheric end of the path.

Various mechanisms have been used to prevent a spark during removal of the plug from the housing receptacle. Some devices have provided a direct mechanical linkage within the housing extending from the receptacle to the switch in such a manner that insertion of the plug turns the switch "on" and removal of the plug turns the switch "off". Others have provided mechanical interlocks between an external switch operating handle and the receptacle which prevent the plug from being removed unless the switch is in its "off" position. Still others have provided a mechanical locking mechanism extending between the receptacle and the mechanical actuating mechanism. Such locking mechanisms prevented the switch from being moved to its "on" position unless a plug was received in the receptacle and/or prevented plug removal from the receptacle unless the switch was in its "off" position. Devices of this general type are shown, for example, in U.S. Pat. No. 1,818,290 issued August 1931 to W. A. Wulle and U.S. Pat. No. 2,015,543 issued September, 1935 to C. H. Bissell.

Various problems have been observed in the prior art actuation mechanisms. In those mechanisms in which the interaction between the plug and receptacle move the enclosed switch between its "on" and "off" positions, a spark may be caused between the plug and receptacle. Those actuating mechanisms which allow the switch to be operated in the absence of a plug fully mated in the receptacle are unsuitable for applications in which the switch is connected with a source of power.

In view of the foregoing, it has been considered desirable to develop a new and improved actuating mechanism. The subject development contemplates such an arrangement which overcomes the above-referenced problems and others.

SUMMARY OF THE INVENTION

In accordance with the present invention, an interlocking plug and receptacle mechanism is provided which includes actuating means for operating an electrical device which is environmentally isolated from the atmosphere. The electrical device has at least a first and a second state and includes a toggle switch lever movable between a first position corresponding to the first state and a second position corresponding to the second state. The electrical device is disposed in environmental isolation in an enclosure which includes an electrical plug receiving receptacle. An actuating linkage connects the toggle switch lever with an operating handle mounted on the exterior of the enclosure. The actuating linkage provides a first mechanical advantage between the operating handle and the toggle switch lever adjacent the first position and a second mechanical advantage adjacent the second position.

According to a more specific aspect of the invention, the electrical device comprises a circuit breaker having four states and wherein a toggle switch lever is positionable in "on", "off", "trip", and "reset" positions, The actuating linkage connects the operating handle with the toggle switch lever at the first mechanical advantage when the operating handle and toggle switch lever are adjacent their "on" positions and at the second mechanical advantage when the operating handle and toggle switch lever are adjacent their "reset" positions. The first mechanical advantage is less than the second mechanical advantage. In this manner, the first mechanical advantage facilitates movement of the operating handle by the toggle switch lever when the circuit breaker is tripped and the higher, second mechanical advantage facilitates resetting the circuit breaker.

According to another aspect of the invention, a locking means is further provided which is operatively connected with the actuating linkage and the receptacle. This locking means locks the toggle switch lever in the second position in the absence of a plug being fully received in the receptacle and locks a plug which is fully received in the receptacle when the toggle switch is in the first position.

In accordance with a more limited aspect of the invention, the locking means includes a locking lever which is pivotally mounted for arcuate movement between first and second positions. The locking lever is configured to be engaged by a plug received in the receptacle such that the locking lever is thereby moved from the first to the second position. A locking pawl is operatively connected with the locking lever. When the locking lever is in the first position, the locking pawl is in an extended position in engagement with the actuating linkage for preventing the toggle switch lever from changing positions. When the locking lever is in the second position, the locking pawl is in a retracted position in which the actuating linkage is released to allow the toggle switch lever to move between the first and second positions. The locking lever also includes a locking finger for prohibiting withdrawal of the plug until the locking lever has been returned to the first position.

A primary advantage of the present invention is that it permits circuit breakers, switches, and other potentially sparking electrical devices to be used safely in flammable, wet, and other potentially hazardous environments.

Another advantage resides in the provision of a safety lock between enclosed switches, circuit breakers, and other such electrical devices and an associated plug receiving receptacle. This safety lock prevents operating the electrical device in the absence of a fully received plug and prevents removal of the plug when the electrical device is in other than an "off" state.

Yet another advantage of the invention is in the provision of a non-linear linkage between an exterior operating handle and an enclosed circuit breaker. The non-linear mechanical advantage facilitates the circuit breaker moving the operating lever when the circuit breaker is tripped from its "on" position. At the same time, the invention provides an improved mechanical advantage from the operating handle to the circuit breaker when the operating handle is moved toward the "reset" position to facilitate resetting the circuit breaker.

Still further advantages of the present invention will become apparent to those skilled in the art upon reading and understanding the following detailed description of the preferred embodiment.

BRIEF DESCRIPTION OF THE DRAWINGS

The invention may take form in various parts and arrangement of parts. The drawings are merely for purposes of illustrating a preferred embodiment and are not to be construed as in any way limiting the invention.

FIG. 5 is a cross-sectional view generally along lines 5—5 of FIG. 2;

FIG. 6 is a perspective view illustrating an actuating mechanism formed in accordance with the present invention with an electrical plug spaced from association therewith;

DETAILED DESCRIPTION OF THE PREFERRED EMBODIMENT

Figure 1:
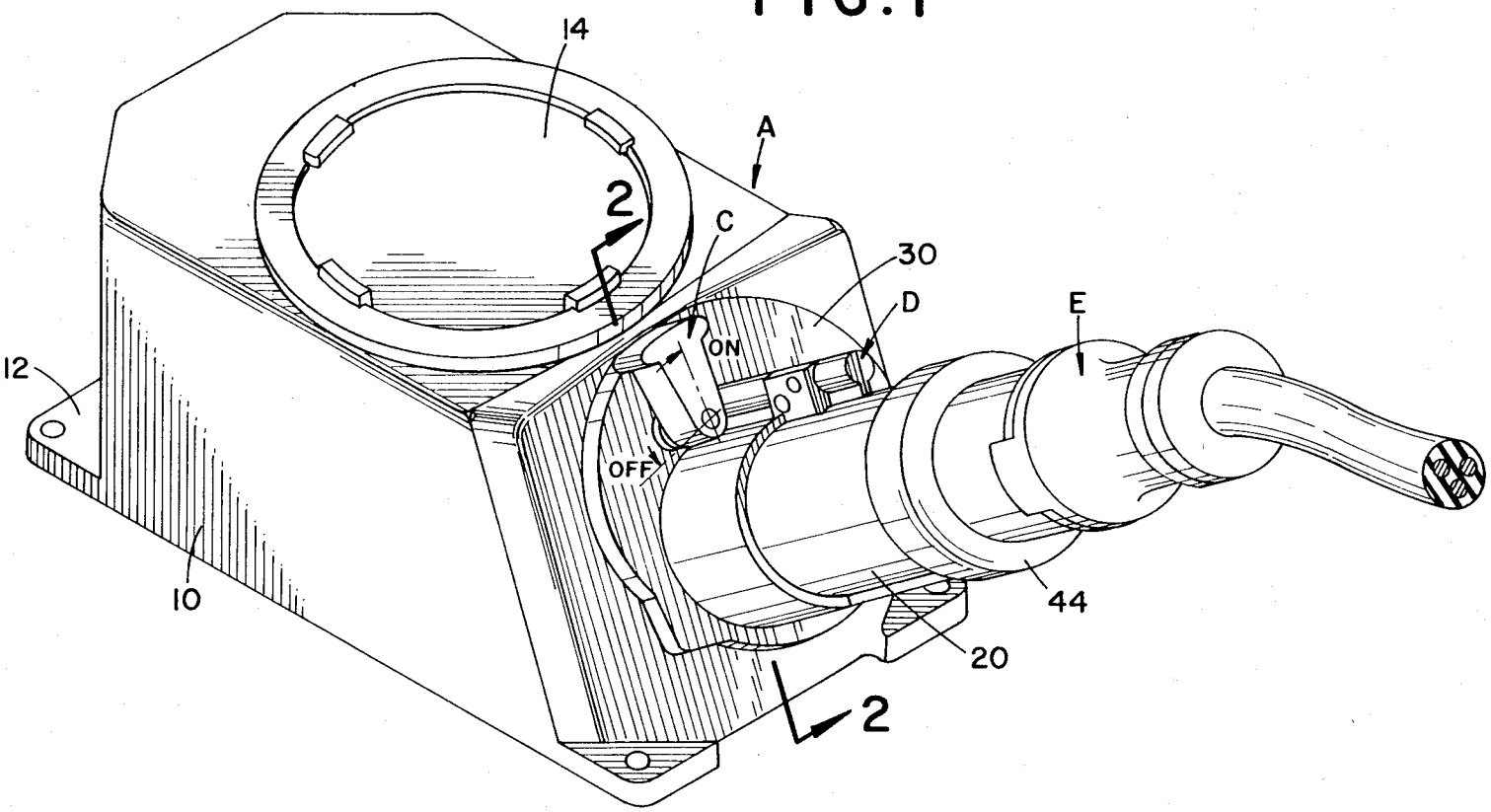
FIG. 1 is a perspective view of an environmentally isolating housing which includes an actuating mechanism formed in accordance with the present invention operatively interconnected with an electrical plug.
Figure 2:
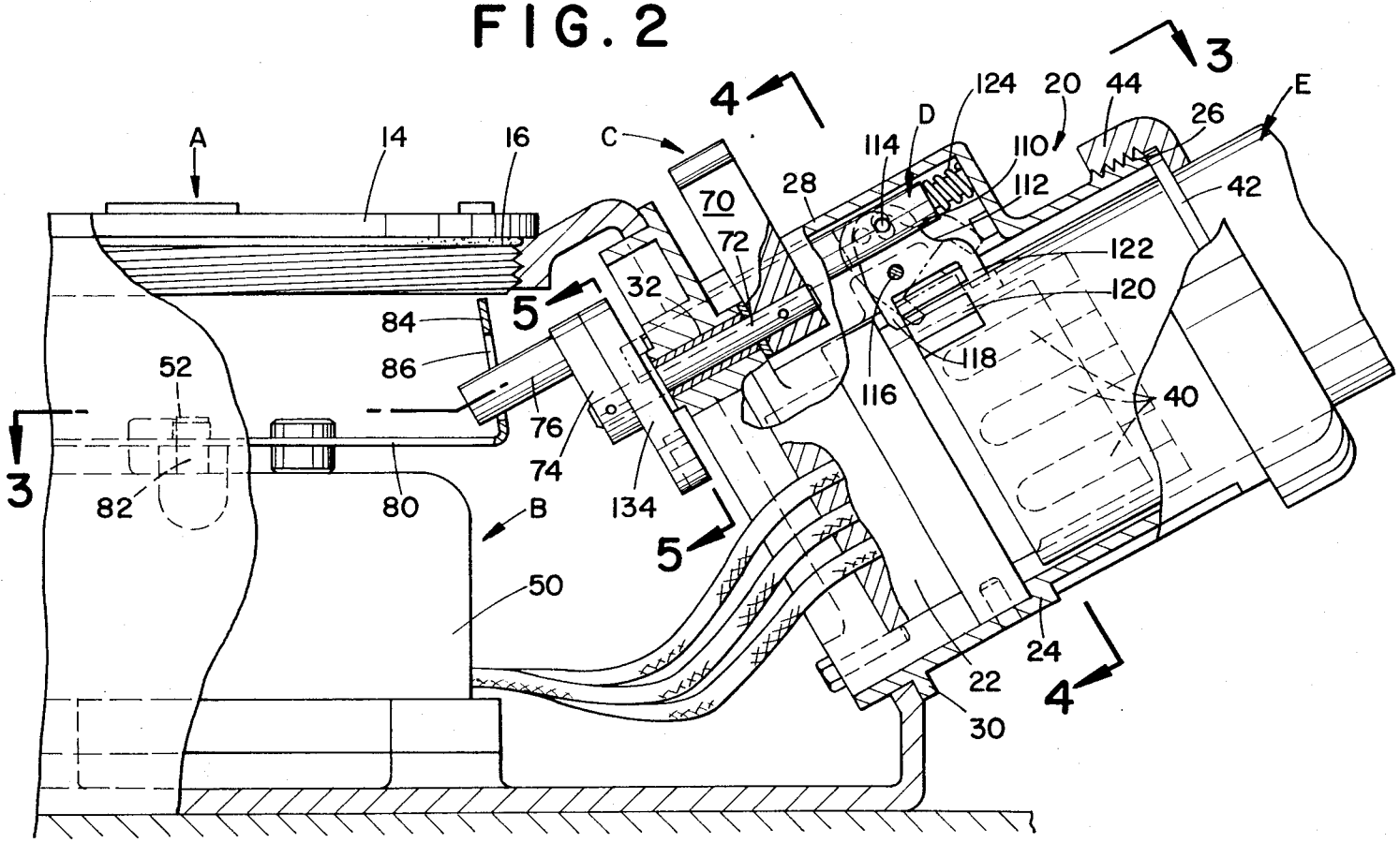
FIG. 2 is a side elevational view in partial cross-section generally along lines 2—2 of FIG. 1.
Figure 3:
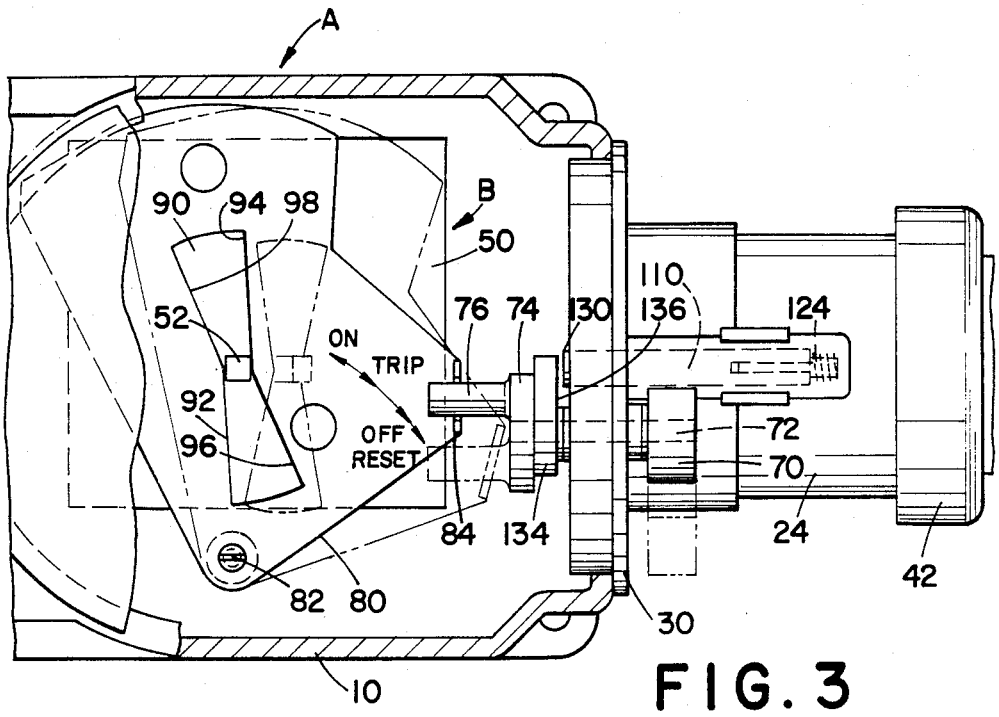
FIG. 3 is a cross-sectional view generally along lines 3—3 of FIG. 2.

Referring now to the drawings wherein the showings are for purposes of illustrating the preferred embodiment of the invention only and not for limiting same, FIGS. 1–3 show an enclosure A which has its interior environmentally isolated from the surrounding atmosphere. Isolation connotes a sufficient separation so that, if flammable vapors or dust in the interior should be ingnited, the ignition will not spread to like flammable vapors or dust in the surrounding atmosphere and is understood to connote a degree of isolation which can be less than complete, hermetic separation.

A potentially sparking electric device B such as a switch, circuit breaker, or the like is isolated from the atmosphere by the surrounding enclosure A. An actuating linkage or means C extends through the enclosure A into operative connection with the electric device B to enable it to be operated from the exterior of the enclosure A. A locking mechanism or means D is operatively connected with the actuating linkage C for locking it from operating the electrical device B in the absence of a fully received electrical plug E and for locking the plug E against removal in the absence of the electrical device B being in a preselected state.

More particularly, the enclosure A includes a body portion 10 which has a wall strength sufficient to withstand the pressure of an internal ignition of flammable gases or dust without rupturing, e.g., 800 to 1,000 psi, in most applications. The body portion 10 is connected with a suitable mounting means 12 for mounting the enclosure securely. An access means including a plate 14 which is received in an access port by threads, a bayonet connection, or the like provides access to the interior of the enclosure. A gasket or seal 16, which may be constructed of an elastomeric material, a heat resistant compressive material, a soft metal, or the like, is compressed between the access plate and the housing.

With primary reference to FIG. 2, the enclosure further includes a plug receiving receptacle 20. The receptacle 20 includes a plurality of electrically conductive female contacts mounted in an insulative block 22. The insulative block is mounted in a metal peripheral wall 24 which is threaded at its outer end 26 to provide for a more secure interconnection with the plug E. The peripheral receptacle wall 24 has an enlarged portion 28 which houses the locking means D within the environmentally isolated region. The peripheral receptacle wall 24 terminates at its inner end with a plate 30. The plate 30 has an aperture therethrough which is lined by a bushing 32 for movably receiving the actuating linkage C without disrupting the environmental isolation.

The plug E includes a plurality of male electrical contacts 40 which are adapted to be received in the female electrical contacts of the enclosure A. A collor or stop 42 engages the outer end 26 of the receptacle to limit the plug's receipt therein. A threaded collar 44 selectively clamps the stop collar 42 to the receptacle outer end 26 to lock the plug E and receptacle 20 in their fully mated relationship.

With particular reference to FIGS. 2 and 3, the electrical device B includes a circuit breaker 50 electrically connected with the female electrical contacts of the receptacle 20. The circuit breaker 50 includes a toggle switch lever 52 which is movable between at least a first position and a second position. Preferably, the toggle switch lever 52 is movable between four positions —'-'on", "trip", "off", and "reset". In each toggle switch lever position, the circuit breaker is in a corresponding state. In the "on" or first position, the circuit breaker 50 provides a closed electrical path therethrough. In the "off" or second position, the circuit breaker 50 breaks electrical continuity therethrough. The circuit breaker 50 assumes the "trip" or third position in response to an overload condition. In the "trip" position, the circuit breaker 50 also breaks electrical continuity. After the circuit breaker 50 has moved the toggle switch lever 52 into the "trip" position, it can only be returned to the "on" position by passing through the "reset" or fourth position.

Typically, moving the toggle switch lever 52 through the "reset" position removes a latch which prevents the bimetallic element from returning on its own to the "on" position and moves the bimetallic element back to the "on" position. It is to be appreciated that other electrical devices are contemplated such as a switch with "on" and "off" positions or states, a motor starter with "on" and "off" or "on", "off", and "start" positions or states, and other electrical devices having two or more states. Such other devices do not in any way depart from the overall intent or scope of the present invention.

Figure 4:
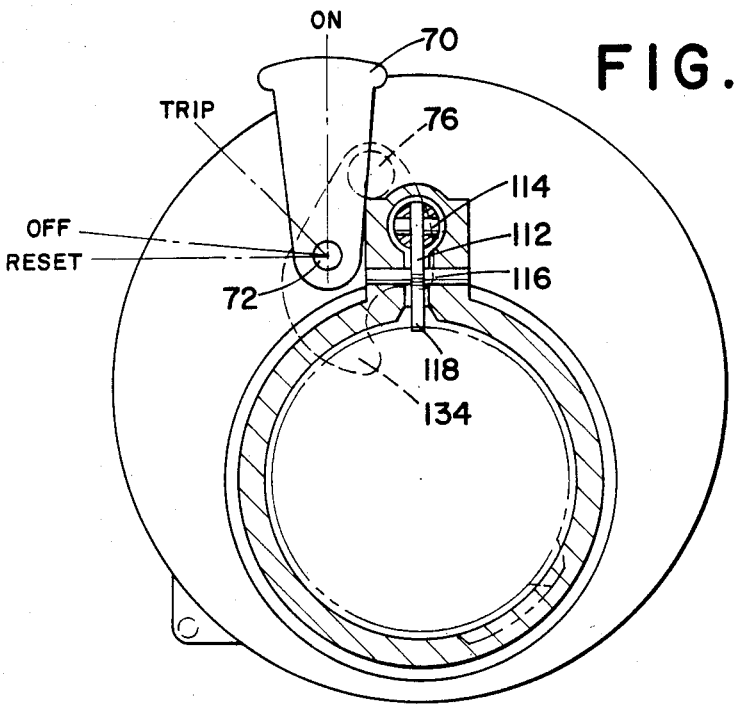
FIG. 4 is a cross-sectional view generally along lines 4—4 of FIG. 2.

With continuing reference to FIGS. 2 and 3 as well as with reference to FIGS. 4 and 5, the actuating linkage C includes an operating handle 70 which is rotatably mounted on a handle shaft 72. The handle shaft 72 is rotatably mounted through the bushing 32 and connects with a first lever arm 74 in the enclosure interior. The first lever arm is connected at one end with the handle shaft 72 and its other end with an actuator pin 76.

A slide plate 80 is mounted for angular rotation about a pivot screw 82. The slide plate 80 includes an upstanding tab 84 defining a vertical actuator slot 86 which slidably receives the actuator pin 76. The slide plate 80 defines a second lever arm between the pivot screw 82 and the actuator pin slot 86.

The slide plate 80 includes a butterfly-shaped aperture 90 which receives the toggle switch lever 52. The butterfly-shaped aperture 90 includes a first pair of parallel spaced surfaces 92 and 94 which are disposed generally parallel with either side of the toggle switch lever 52 in its "on" position. A second pair of surfaces 96 and 98 are disposed generally parallel with either side of the toggle switch lever 52 in its "off" position. In this manner, the slide plate 80 is adapted to receive toggle switch levers of greater width than that illustrated in FIG. 3. The slide plate 80 defines a third lever arm between the toggle switch lever 52 and the pivot screw 82. The toggle switch lever 52 defines a fourth lever arm between the circuit breaker 50 and the slide plate 80.

In the preferred embodiment, the relative physical dimensions of the first, second, third, and fourth lever arms are selected such that in the "on" position, the first lever arm 74 is disposed approximately 30° from vertical. As the operating handle 70 moves through about the first 60° from the "on" position, the first lever arm 74 moves from about 30° on one side of vertical to about 30° on the other side of vertical. This 60° travel of the handle 70 and first lever arm 74 moves the third lever arm through an arc of about 12° and the fourth lever arm through an arc of about 14°. In this 60° range of movement adjacent the "on" position, the operating handle has a mechanical advantage relative to movement of the toggle switch lever 52 in the range of about 2:1 to 2.5:1. Because the mechanical advantage is relatively low, the toggle switch lever 52 requires less force when the circuit breaker is tripped to move the operating handle 70 from its "on" to "tripped" positions than it would if the mechanical advantage were higher.

Between the "on" and "off" positions, the operating handle 70 and first lever arm 74 move through an arc of about 93°, the third lever arm moves through an arc of about 19°, and the fourth lever moves through an arc of about 22°. As the operating handle 70 moves the first lever arm 74 past the vertical and toward a horizontal orientation, progressively greater angular displacement of the operating handle 70 and first lever arm 74 are required to move the actuator slot 86 the same distance or the third lever arm the same number of degrees, i.e., the mechanical advantage increases. More specifically, the mechanical advantage increases generally exponentially as the first lever arm 74 approaches a horizontal orientation. In the "off" position, the first lever arm 74 is disposed at about 65° from the vertical and in the "reset" position, about another 5° further from the vertical. In the range of 65°–70° from the vertical, the operating handle 70 achieves a mechanical advantage relative to the fourth lever arm in the range of approximately 7:1 to 7.5:1. This relatively high mechanical advantage reduces the force which must be applied to the operating handle 70 to reset the circuit breaker 50 over the force which would be required with a lower mechanical advantage.

With reference to FIGS. 2, 4, and 5, the locking means D includes a linear motion locking bolt or pawl 110 which is mounted in the receptacle enlargement 28 for sliding movement parallel to the axis of the receptacle. A locking lever 112 is pivotally connected at one end with the locking pawl 110 and pivotally connected at an intermediate region to the receptacle by a pivot 116. The locking lever 112 pivots between a first or plug receiving position (shown in phantom in FIG. 2) and a second or plug locking position (shown in solid in FIG. 2). The locking lever 112 has an inner finger 118 which is engaged by a projection 120 on the plug E to cause the locking lever 112 to pivot about the intermediate pivot 116 for raising the locking pawl 110 from an extended position (FIG. 5) to a retracted position (FIG. 2). An outer or locking finger 122 is adapted to engage the plug projection 120. To retract the plug, the locking lever 112 must pivot for moving the locking pawl 110 into the extended position. A biasing means 124, such as a coil spring or the like, biases the locking pawl 110 toward its extended position.

With particular reference to FIG. 5, an end 130 of the locking pawl 110 engages a locking recess 132 of a locking plate 134 in the extended position. The locking plate 134 is connected with the handle shaft 72 and the first lever arm 74 to be rotated therewith. The locking plate 134 has a locking pawl engaging surface 136 adapted to contact the end 130 of the locking pawl 110 after the operating handle 70 is rotated from the "off" position. In this manner, the interaction of the locking pawl end 130 and the locking recess 132 prevents the operating handle 70 from being rotated from the "off" position until a plug projection 120 engages a finger 118 to lift the locking pawl 110 against the biasing spring 124. Thereafter, and once the operating handle 70 is rotated from the "off" position, the pawl engaging surface 136 blocks the locking pawl 110 such that interaction between the second finger 122 and the plug projection 120 prohibits the plug from being removed.

With reference to FIG. 6, the actuating mechanism is illustrated locked is its "off" position. Before the plug projection 120 engages the inner finger 118, the biasing means 124 biases the engaging end 130 of the locking pawl 110 into the locking recess 132. This prevents operating handle 70 from being angularly displaced about the rotatable shaft 72, locking the handle in its "off" position and the electrical device in its "off" state.

Figure 7:
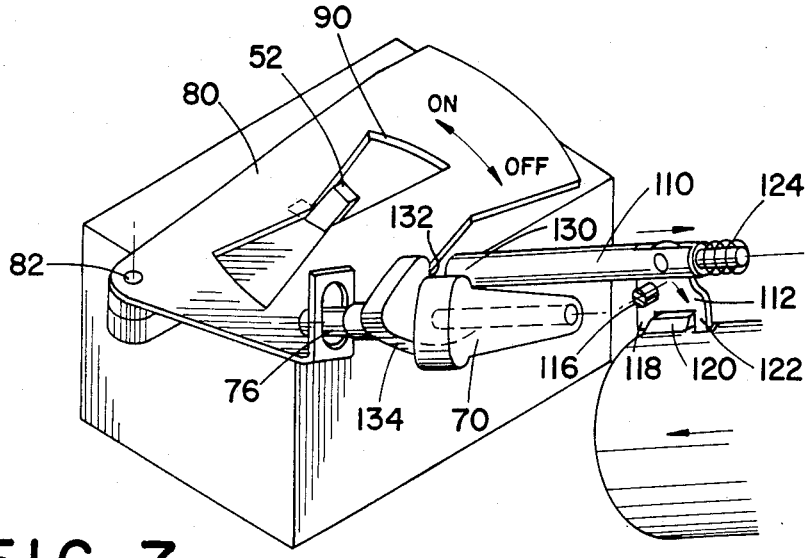
FIG. 7 is a perspective view similar in FIG. 6 with the electrical plug in the fully received position and with an enclosed electrical switch in the "off" position; and, FIG. 8 is a perspective view similar to FIG. 6 with the plug in the fully received position and with an enclosed switch in the "on" position.

With reference to FIG. 7, as the plug projection 120 engages the finger 118, it urges the locking lever 112 to rotate about the middle pivot 116 retracting the locking pawl 110 against the biasing spring 124. When the plug is fully received, the engaging end 130 of the locking pawl 110 is fully withdrawn from the locking recess 132. This allows the operating handle 70 to be rotated from its "off" position toward its "on" position.

Figure 8:
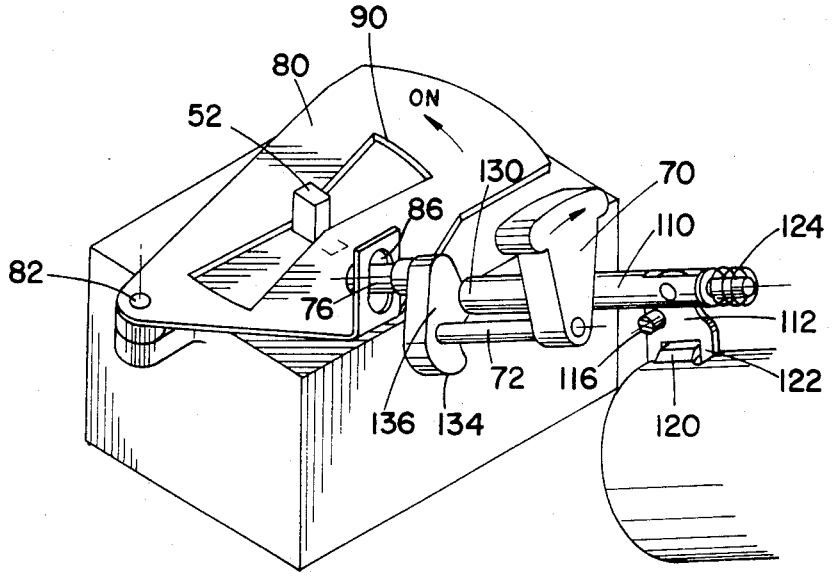

With reference to FIG. 8, once the operating handle 70 is rotated a few degrees from the "off" position, the pawl engaging surface 136 of the locking plate 134 prevents the locking pawl 110 from moving back toward its extended position which, in turn, prevents the locking lever 112 from pivoting around pivot 116. The plug locking finger 122 engages the plug projection 120 to thereby lock the plug against withdrawal. The operating handle 70 can be rotated freely to move the toggle switch lever 52 to its "on" position. Further, the toggle switch lever 52 can be moved by the circuit breaker 50 to its "tripped" position and, in turn, move the operating handle 70 to its corresponding "trip" position. The handle 70 is further freely rotatable past the "off" position to the "reset" position to reset the circuit breaker 50 and back to the "on" position.

The invention has been described with reference to the preferred embodiment. Obviously, modifications and alterations will occur to others upon reading and understanding the preceding detailed description. It is intended that the invention be construed as including all such alterations and modifications insofar as they come within the scope of the appended claims or the equivalents thereof.

Having thus described the invention, it is now claimed:

1. An actuating mechanism for operating a circuit breaker and other electrical device which is environmentally isolated from the atmosphere, the mechanism comprising:

an enclosure including an electrical plug receiving receptacle;

a circuit breaker having a toggle switch lever which is selectively positionable in "on", "off", "trip", and "reset" positions, the circuit breaker being disposed in environmental isolation within the enclosure and being electrically connected with the receptacle; and, an actuating linkage means for operatively connecting the toggle switch lever with an operating handle which is movably mounted on the exterior of the enclosure, the actuating linkage means connecting the operating handle with the toggle switch lever with a first mechanical advantage when the toggle switch lever is adjacent the "on" position and with a second mechanical advantage when the toggle switch lever is adjacent the "reset" position, the first mechanical advantage being less than the second mechanical advantage, whereby the first mechanical advantage facilitates the movement of the operating handle by the toggle switch lever when the circuit breaker is tripped and the second mechanical advantage facilitates resetting the circuit breaker.

2. The mechanism as set forth in claim 1 further including a locking means operatively connected with the actuating linkage and with the receptacle for locking the toggle switch lever in the "off" position in the absence of a plug fully received in the receptacle and for locking the plug fully received in the receptacle in the absence of the toggle switch lever being in the "off" position.

3. The mechanism as set forth in claim 2 wherein the actuating linkage means includes a first lever arm operatively connected with the operating handle to be arcuately displaced with movement of the operating handle, another lever arm operatively connected with the toggle switch lever which undergoes arcuate displacement with movement of the toggle switch lever, the first and the another lever arms being operatively connected.

4. The mechanism as set forth in claim 2 wherein the locking means includes a locking lever which is pivotally mounted to be arcuately displaced by engagement with a projection on a received plug, a locking pawl operatively connected with the locking lever such that interaction between the locking lever and the projection on the received plug retracts the locking pawl out of locking engagement with the actuating linkage means.

5. The mechanism as set forth in claim 4 wherein the locking means further includes a locking plate operatively connected with the actuating linkage means, the locking plate including a locking recess for receiving the locking pawl to lock the actuating linkage means against movement and the locking plate including a pawl engaging surface for locking the pawl in the retracted position when the operating handle is moved from the "off" position, and wherein the locking lever locks the plug projection against withdrawal when the locking pawl is in the retracted position.

6. An actuating mechanism for operating a circuit breaker or other electrical device which is environmentally isolated from the atmosphere, the mechanism comprising:

an enclosure including an electrical plug receiving receptacle;

a circuit breaker having a toggle switch lever which is selectively positionable in "on", "off", "trip", and "reset" positions, the circuit breaker being disposed in environmental isolation within the enclosure and being electrically connected with the receptacle; and, an actuating linkage for connecting the toggle switch lever with an operating handle which is movably mounted on the exterior of the enclosure, the actuating linkage including:

a first lever arm operatively connected with the operating handle to be arcuately displaced with movement thereof, and a slide plate which is pivotally mounted for arcuate displacement, the slide plate being operatively connected with the toggle switch lever for moving it between positions with the arcuate displacement thereof and being operatively connected with the first lever arm such that when the toggle switch lever is adjacent the "on" and "trip" positions, the first lever arm provides the operating handle a first, relatively low mechanical advantage relative to the toggle switch lever, whereby the first mechanical advantage facilitates the movement of the operating handle by the toggle switch lever when the circuit breaker is tripped; and when the toggle switch lever is adjacent the "off" and "reset" positions, the first lever arm provides the operating handle a second, relatively high mechanical advantage relative to the toggle switch lever, whereby the second mechanical advantage facilitates resetting the circuit breaker.

7. The mechanism as set forth in claim 6 wherein the first lever arm includes an actuating pin and the slide plate includes a slot which receives the actuating pin to provide the operative connection between the first lever arm and the slide plate.

8. The mechanism as set forth in claim 7 wherein the first lever arm is disposed for arcuate movement in a first plane and the slide plate is disposed for arcuate movement in a second plane, the first and second planes being generally perpendicular to each other.

9. The mechanism as set forth in claim 8 wherein in the "on" position, the first lever arm is disposed generally perpendicular to the second plane, in the "off" position the first lever arm is disposed more nearly parallel to the second plane, in the "trip" position the first lever arm is disposed between its "on" and "off" positions, and in the "reset" position the first lever arm is disposed more nearly parallel with the second plane than in the "off" position.

10. An actuating mechanism for operating an electrical device which has at least a first and second state and which includes a toggle switch lever movable between at least a first position corresponding to the device first state and a second position corresponding to the second state, the mechanism comprising:

an enclosure including an electrical plug receiving receptacle, the electrical device being disposed in environmental isolation within the enclosure;

an actuating linkage for connecting the toggle switch lever with an operating handle which is mounted on the exterior of the enclosure, the operating handle being movable between at least first and second positions, the actuating linkage connecting the toggle switch lever and the operating handle such that the toggle switch lever and operating handle undergo coordinated movement between the first and second positions; and, a locking means including a locking lever which is pivotally mounted for movement between a first locking lever position and a second locking lever position, the locking lever being configured to be engaged by a plug received in the receptacle such that receipt of the plug in the receptacle moves the locking lever from the first locking lever position to the second locking lever position, a locking pawl operatively connected with the locking lever such that when the locking lever is in the first locking lever position, the locking pawl is in an extended position in which it engages the actuating linkage to prevent the toggle switch lever from changing positions and when the locking lever is in the second position, the locking pawl is in a retracted position in which the actuating linkage is released to allow the toggle switch lever to move between the first and second positions, the locking lever including a locking finger means for prohibiting withdrawal of the plug without returning the locking lever to the first locking lever position.

11. An actuating mechanism for operating an electrical device which has at least a first and second state and which includes a toggle switch lever movable between at least a first position corresponding to the device first state and a second position corresponding to the second state, the mechanism comprising:

an enclosure including an electrical plug receiving receptacle, the electrical device being disposed in environmental isolation within the enclosure;

an actuating linkage for connecting the toggle switch lever with an operating handle which is mounted on the exterior of the enclosure, the operating handle being movable between at least first and second positions, the actuating linkage connecting the toggle switch lever and the operating handle such that the toggle switch lever and operating handle undergo coordinated movement between the first and second positions; and, a locking means including:

a locking lever which is pivotally mounted for movement between a first locking lever position and a second locking lever position, the locking lever being configured to be engaged by a plug received in the receptacle such that receipt of the plug in the receptacle moves the locking lever from the first locking lever position to the second locking lever position, the locking lever including a locking finger means for prohibiting withdrawal of the plug without returning the locking lever to the first locking lever position, a locking pawl operatively connected with the locking lever such that when the locking lever is in the first locking lever position, the locking pawl is in an extended position in which it engages the actuating linkage to prevent the toggle switch lever from changing positions and when the locking lever is in the second position, the locking pawl is in a retracted position in which the actuating linkage is released to allow the toggle switch lever to move between the first and second positions, and an engaging surface for retaining the locking pawl in the retracted position, the engaging surface being operatively connected with the operating handle to be selectively moved into a path between the locking pawl extended and retracted positions when the handle is in the first handle position such that the locking lever is blocked from moving to the first locking lever position and the plug is locked in the receptacle.

12. The mechanism as set forth in claim 11 wherein the locking means includes biasing means for biasing the locking pawl toward the extended position.

13. The mechanism as set forth in claim 12 wherein the actuating linkage includes a first lever arm operatively connected with the operating handle, a pivotally mounted slide plate operatively connected with the toggle switch lever, the slide plate defining an elongated slot which receives a pin mounted on the first lever arm slidingly therein.

14. An actuating mechanism for operating an electrical device having at least a first and a second state and a toggle switch lever movable between a first position corresponding to the first state and a second position corresponding to the second state, the mechanism comprising:

an enclosure in which the electrical device is received for environmentally isolating the electrical device from the atmosphere, the enclosure including an electrical plug receiving receptacle;

an actuating linkage for connecting the toggle switch lever with an operating handle which is mounted on the exterior of the enclosure, the actuating linkage including a first lever arm operatively connected with the handle to be arcuately displaced in a first plane therewith, a slide plate which is pivotally mounted for arcuate movement in a second plane and which includes an aperture therein for receiving the toggle switch lever, the first lever arm and slide plate being operatively connected to undergo coordinated angular displacement; and, a locking means including a pivotally mounted locking lever disposed adjacent the receptacle to be pivoted upon receipt of a plug in the receptacle, a locking pawl operatively connected with the locking lever to be moved thereby between an extended position in the absence of a plug in the receptacle and a retracted position in the presence of a plug received in the receptacle, a locking plate operatively connected with the operating handle and including a locking pawl receiving recess for receiving the locking pawl in its extended position for locking the toggle switch lever in the second position and having a pawl engaging surface for blocking the locking pawl against moving from the retracted position to the extended position when the toggle switch lever is in the first position.

15. The mechanism as set forth in claim 14 wherein the slide plate includes an elongated slot which slidably receives a pin that is mounted on the first lever arm.

16. The mechanism as set forth in claim 15 wherein the locking lever includes a locking finger which engages a received plug to prevent withdrawal of the plug without pivoting the locking lever and moving the locking pawl to its extended position.

17. An actuating mechanism for operating an electrical device which has at least a first state, a second state, and a third state, and which is environmentally isolated from the atmosphere, the electrical device including a toggle switch lever movable between a first position corresponding to the electrical device first state, a second position corresponding to the electrical device second state, and a third position corresponding to the electrical device third state, the actuating mechanism comprising:

an enclosure including an electrical plug receiving receptacle and containing the electrical device in environmental isolation therein;

an actuating linkage for connecting the toggle switch lever with an operating handle that is mounted on the exterior of the enclosure, the actuating linkage including:

a rotatable shaft operatively connected with the operating handle to be rotated therewith, a first lever arm operatively connected with the rotatable shaft to be angularly displaced with rotation of the shaft, a slide plate which is mounted to a slide plate pivot for pivotal movement thereabout, the slide plate being operatively connected with the toggle switch lever for moving the toggle switch lever among the first, second, and third positions thereof, an actuator pin slidably received in an elongated actuator slot to define a point of connection between the slide plate and the first lever arm, the actuator pin being operatively connected with one of the first lever arm and the slide plate and the elongated actuator slot being defined by the other of the first lever arm and the slide plate, the first lever arm and the slide plate being disposed relative to each other (a) such that as the toggle switch lever moves between the first and second positions, the first lever arm is angularly displaced through a first angular range which is generally perpendicular a path of movement of the slide plate at said point of connection, whereby the operating handle has a first, relatively low mechanical advantage relative to the toggle switch lever to facilitate movement of the toggle switch lever causing a corresponding movement of the operating handle and (b) such that when the toggle switch lever is in the third position, the first lever arm is more nearly parallel to said slide plate path of movement than the first angular range, whereby the operating handle has a second, relatively high mechanical advantage relative to the toggle switch lever to facilitate moving the toggle switch lever from the third position with the handle.

18. The mechanism as set forth in claim 17 further including a locking means operatively connected with the actuating linkage and with the receptacle for locking the toggle switch lever in the third position in the absence of a plug fully received in the receptacle and for locking the plug fully received in the receptacle when the toggle switch lever is in the first and second positions.

19. The mechanism as set forth in claim 17 wherein the slide plate defines the elongated actuator slot therein perpendicular to said path of movement and wherein the first angular range is centered substantially parallel to the elongated actuator slot.

20. The mechanism as set forth in claim 19 wherein the first angular range extends about 30° to either side of the elongated actuator slot.

21. The mechanism as set forth in claim 20 wherein in the third position, the first lever arm is disposed at least 60° from parallel with the elongated actuator slot.

* * * * *